United States Patent [19]

Kurple

[11] 4,422,016

[45] Dec. 20, 1983

[54] CONSTANT ENERGY TRANSFER RATE STROBE SOURCE

[75] Inventor: William M. Kurple, Urbana, Ohio

[73] Assignee: Midland-Ross Corporation, Cleveland, Ohio

[21] Appl. No.: 313,744

[22] Filed: Oct. 22, 1981

[51] Int. Cl.[3] ..... H05B 37/00

[52] U.S. Cl. ..... 315/241 S; 315/287; 315/308

[58] Field of Search ..... 315/287, 308, 241 S

[56] References Cited

U.S. PATENT DOCUMENTS

| | | | |
|---|---|---|---|
| 3,644,818 | 2/1972 | Paget | 315/241 S |
| 4,005,337 | 1/1977 | Rabe | 315/241 S |
| 4,039,897 | 8/1977 | Dragoset | 315/287 |
| 4,277,728 | 7/1981 | Stevens | 315/308 |

*Primary Examiner*—Harold Dixon

*Attorney, Agent, or Firm*—H. Duane Switzer

[57] ABSTRACT

A strobe light power source transfers a constant amount of energy to a capacitor bank for each flash of a strobe lamp by maintaining a constant energy transfer rate between a power source and the capacitor bank and allowing the capacitor bank to charge for a set period of time. The effective value of the input current to a charging circuit connected between the power source and the capacitor bank can be maintained at a constant value to provide an approximately constant energy transfer rate. Such constant current control is most effective for a source having a relatively constant output voltage. In sources where the output voltage varies over time, both the input current and voltage to the charging circuit are monitored, combined and integrated to generate a duty cycle output signal which controls the charging circuit. A timer circuit is provided to set time periods during which the capacitor bank is charged at the constant rate to provide constant energy for each flash of the strobe light. The timer circuit can trigger or activate the strobe lamp and also prevent recharging of the capacitor bank for afterglow protection of the strobe lamp.

14 Claims, 2 Drawing Figures

CONSTANT ENERGY TRANSFER RATE STROBE SOURCE

BACKGROUND OF THE INVENTION

This invention relates to apparatus for storing a predetermined amount of electrical energy in a capacitor bank for discharge through a strobe lamp and, more particularly, to the storage of that electrical energy at a constant rate of energy transfer to the capacitor bank.

Strobe lamps typically comprise a glass bulb in which a gas is sealed which gas when ionized generates high intensity light. The glass bulb typically includes two power electrodes and may include a trigger electrode or may be triggered by external circuitry such as a high voltage transformer. Energy for activating the lamp or ionizing the gas stored within the lamp bulb is generally stored in a bank of capacitors connected in parallel with the lamp. Once a sufficient amount of energy has been stored in the bank of capacitors and it is desired to flash the lamp, a firing pulse is applied to the trigger electrode or external triggering circuitry. The firing pulse ionizes the gas sufficiently to allow current to flow between the two power electrodes which results in the brilliant flash of the strobe lamp.

In the majority of strobe light applications, it is desirable that the strobe lamp light intensity remain above a specified value and approximately constant throughout the operating life of the strobe light. Unfortunately, capacitor banks used in strobe light systems change significantly in capacitance value, both as a result of aging and as a result of variations in ambient temperature. Such capacitance changes are particularly notable in aircraft where severe changes in ambient temperature are routinely encountered. If no correction is made for the variations in capacitance of the capacitor banks, large variations in the amount of energy delivered to the strobe lamp occur over temperature changes and with aging of the strobe light system. Such variations can reduce the life of the strobe light system when excessive energy is provided to the lamp and result in insufficient light intensity at other times.

Various systems have been used to control the energy stored in the capacitor bank. In one such system, the energy stored in the capacitor bank is approximated as a function of the voltage across the bank. Capacitor bank voltage is monitored and compared to a set voltage level to determine when a desired amount of energy has been stored in the bank. A device using this technique is shown in U.S. Pat. No. 3,868,562, issued Feb. 25, 1975. Obviously, such an approach is unacceptable where large capacitance variations in the capacitor bank occur such as in aircraft strobe light systems.

An improved constant energy strobe light system is shown in U.S. Pat. No. 4,005,337, issued Jan. 25, 1977. In this system, the current applied to a capacitor bank is monitored and a signal proportional to that current is integrated and compared to the voltage across the capacitor bank. When the integrated signal equals the voltage across the capacitor bank, the charging of the capacitor bank is interrupted and the energy stored within the capacitor bank can then be discharged through a strobe lamp. In accordance with this technique, equal amounts of energy are applied to the capacitor bank in preparation for each strobe lamp discharge.

While the constant energy strobe source is a great improvement over the technique disclosed in the earlier patent, both of these prior art techniques result in high current levels during energy transfer to the capacitor bank. Not only do such high current levels require high rated circuit devices but they can also lead to higher levels of electromagnetic interference (EMI) generated by the strobe light system. Additionally, in the prior art strobe light systems, if one or more capacitors in the capacitor bank fail and have to be replaced, the prior art units must be reset to ensure proper operation.

SUMMARY OF THE INVENTION

In accordance with the present invention, an improved circuit for supplying uniform amounts of energy to a capacitor bank for a strobe light is provided by regulating the rate of energy transfer and allowing energy transfer at the regulated rate to occur for defined periods of time.

In a strobe light wherein a capacitor bank is successively charged from a power source by a charging circuit such as an inverter transformer, a control circuit is provided for regulating the rate of energy transfer through the charging circuit from the power source to the capacitor bank. A defined amount of energy is transferred to the capacitor bank by setting the time period during which energy is allowed to flow at the regulated transfer rate from the power source to the capacitor bank.

The transfer control circuit monitors the input current to the charging circuit connected between the power source and the capacitor bank and maintains that input current at an approximately constant value to maintain an approximately constant energy transfer rate. Such a constant current control circuit is particularly effective where the output voltage of the power source remains approximately constant. Often times, however, the voltage level of the power source varies over time. Accordingly, the preferred embodiment of the control circuit monitors both the input current and voltage to the charging circuit to maintain an effective value of input current which provides an approximately constant rate of energy transfer from the power source to the capacitor bank.

A current monitoring device is placed in the input side of the charging circuit and a signal representative of the input current is amplified and fed to a summing circuit. The summing circuit also receives a signal representative of the input voltage to the charging circuit. The input current signal is algebraically combined with the input voltage signal and the resulting signal is integrated to generate a voltage level signal indicative of the required effective current necessary to maintain an approximately constant energy transfer rate. This voltage level signal is provided to pulse width modulator, the output signal from which is used to activate a switching device connected into the input side of the charging circuit. The switching device controls the duty cycle of the input current to the charging circuit and thus the effective value of the input current.

A timer circuit is used to control the period of time during whch energy is transferred from the power source to the capacitor bank.

Accordingly, since the charge transfer rate is fixed and the capacitor bank is allowed to charge at the fixed rate for a defined period of time, a constant amount of energy is transferred to the capacitor bank for each flash of the strobe light. The timer can also be used to activate or trigger the strobe lamp since the proper amount of energy has been transferred to the capacitor bank when the timer operates. The frequency of operation of the strobe light is then set by the timer and the charge rate is selected so that the desired amount of energy is transferred to the capacitor bank during the charge time period set by the timer. The timer can also provide afterglow protection for the strobe lamp. After the strobe flashes, the timer prevents the charging circuit from operating for a defined afterglow protection time period to insure that the gas in the lamp bulb deionizes prior to recharging the capacitor bank.

It is an object of this invention to provide an improved strobe lamp energy source which supplies equal amounts of energy to a capacitor storage bank in preparation for each strobe lamp discharge.

It is another object of this invention to supply equal amounts of energy to a capacitor storage bank for each strobe lamp discharge by regulating the rate of energy transfer from the strobe lamp power source to the capacitor bank and setting defined time periods of energy transfer at the regulated energy transfer rate.

It is a further object of this invention to regulate the energy transfer rate between a power source and a capacitor storage bank by maintaining fixed input current to the charging circuit coupling the power source to the capacitor bank.

It is an additional object of this invention to maintain an approximately constant energy transfer rate between a power source and a capacitor storage bank by monitoring the input current and voltage to a charging circuit and thereby controlling the effective value of the input current to maintain the energy transfer rate approximately constant.

These and other objects and advantages of the invention will be apparent from the following description when read with reference to the drawings and the appended claims.

DETAILED DESCRIPTION OF THE INVENTION

Figure 1:
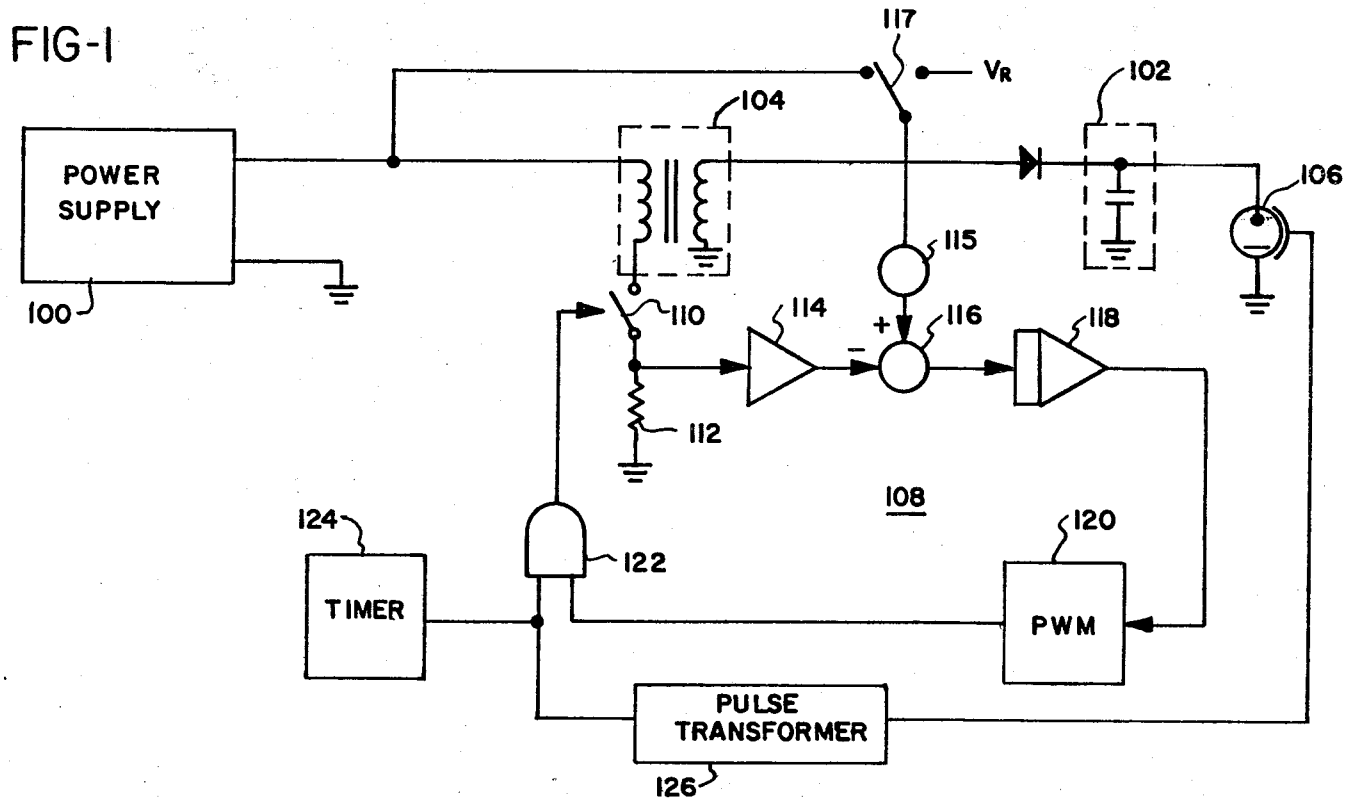
FIG. 1 is a block diagram representation of the strobe light system in accordance with the present invention.

FIG. 1 is a block diagram of a strobe light system in accordance with the present invention. An unregulated DC power source 100 is coupled to a capacitance means such as a capacitor storage bank 102 by a charging means such as an inverter transformer 104 which serves to step up the voltage from the power source 100 to the capacitor bank 102. An inverter is a device that changes direct-current power to alternating-current power. It is noted that other step up coupling circuits and charging means are well known in the art and can also be used in accordance with the present invention.

The capacitor bank 102 is connected in parallel to a strobe lamp 106. The circuitry 108 comprises a energy transfer means or control circuit which regulates the rate of energy transfer from the power source 100 to the capacitor bank 102. The energy transfer rate is regulated by controlling the duty cycle of the input current to the inverter transformer 104.

In accordance with one embodiment of the present invention, the effective input current to the inverter transformer 104 is maintained at an approximately constant value to maintain an approximately constant energy transfer rate. This embodiment of the invention is best suited for power sources which provide an approximately constant output voltage, however, it may be satisfactory for other applications. As is more typically the case, the magnitude of the output voltage of the power source 100 tends to vary with time. Accordingly, both the input current and the input voltage to the inverter transformer 104 are monitored so that the effective input current to the inverter transformer 104 can be regulated to maintain an approximately constant energy transfer rate. That is, as the power source voltage increases, the effective input current is decreased, and when the voltage decreases, the effective input current is increased. In this manner, the rate of energy transfer remains substantially constant.

The primary winding of the inverter transformer 104 is connected to ground potential through the series combination of a switch means 110 and a current sensing resistor 112. The effective value of the primary current through the inverter transformer 104 is sensed by the resistor 112 and amplified by the amplifier 114. Taken together, the current sensing resistor 112 and the amplifier 114 function as a current monitoring means for generating a current signal voltage proportional to the effective value of the input current flowing through the primary winding of the transformer 104. The amplified current signal is combined algebraically with a voltage signal scaled by 115. This combination is performed by the summing means or circuit 116. The voltage signal is either a reference voltage, $V_R$, for the embodiment providing a constant inverter transformer input current or the output voltage of the power supply 100 for the more general embodiment where the inverter input voltage is monitored. The choice between $V_R$ and the inverter input voltage is performed by a selector switch 117.

Figure 2:
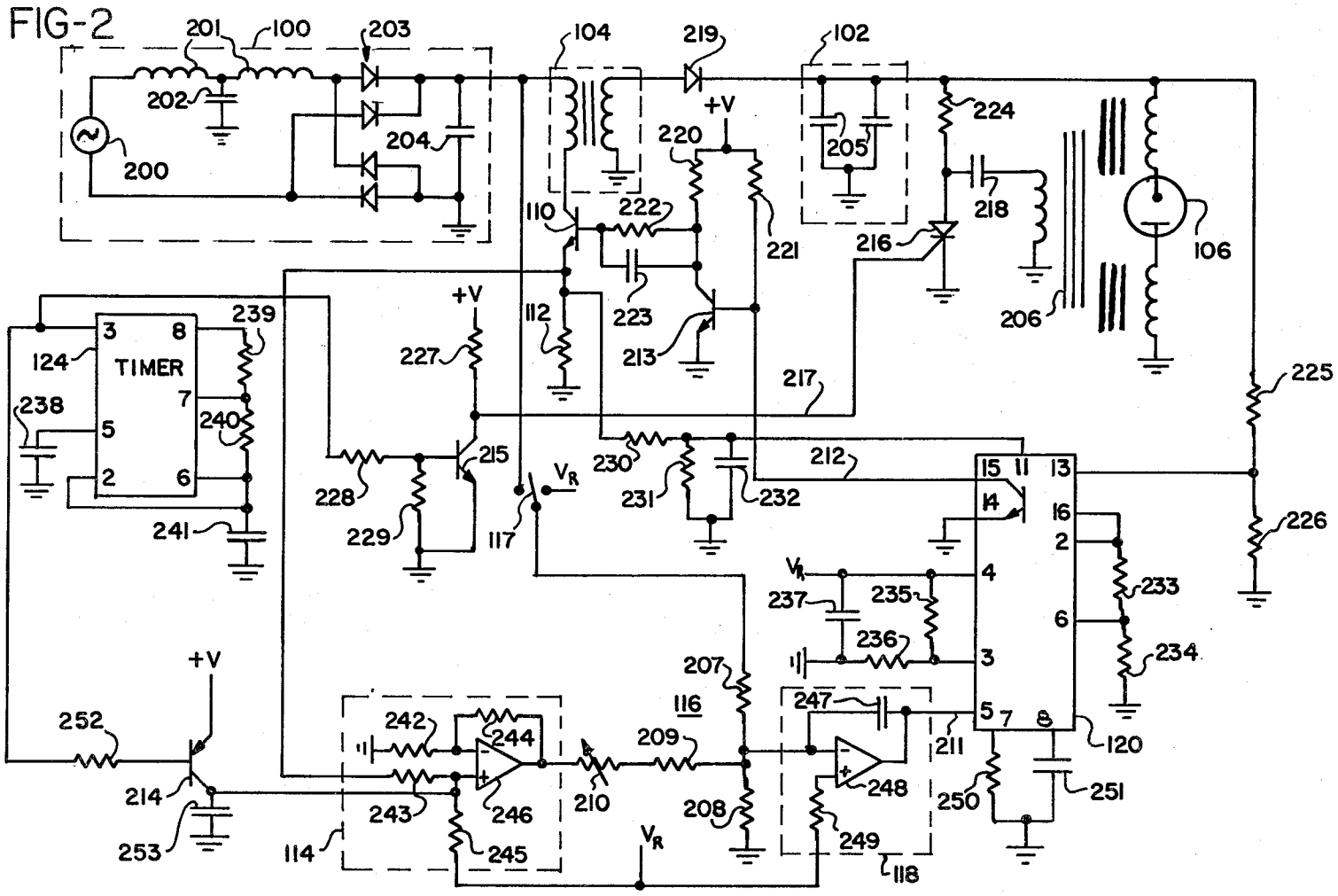
FIG. 2 is a detailed schematic diagram of an illustrative embodiment of the invention.

The current signal is subtracted from the voltage signal (either the referenced voltage $V_R$ or the output voltage of the power supply) and the resulting signal, which is in effect an energy transfer signal, is integrated means or by an integrator circuit 118. The output or error signal from the integrator circuit 118 drives a circuit means such as pulse width modulator 120 which in turn drives the switch 110 through an AND gate 122 to set the duty cycle of the input current through the inverter transformer 104, i.e., defines the duty cycle of the switch means 110. In this manner, the summing means 116, integrating means 118, and pulse width modulator means 120 function together as a switch control means for controlling the duty cycle of the switch means 110 such that an approximately constant rate of energy transfer is provided between the energy source and the capacitor storage bank. Although an integrator circuit 118 is shown in FIGS. 1 and 2, it will be recognized by those skilled in the art that an amplifier and compensation network could be substituted for the integrator circuit of the present invention. Further, the energy transfer means 108 can be constructed to maintain a constant voltage/current product and thus more accurately maintain the energy transfer rate. However, such circuitry, while well within the skill of the art, is more expensive and generally not necessary to meet required specifications.

The energy transfer means 108, in this manner forms a current control means or loop to regulate the effective input current to the inverter transformer 104 and maintains an approximately constant energy transfer rate from the power source 100 to the capacitor bank 102.

The constant energy transfer rate is either established by maintaining a constant effective current into the inverter transformer 104 or by regulating the input current in response to both the output voltage of the power source 100 and the effective current into the inverter transformer 104.

Since the energy transfer rate from the power source 100 to the capacitor bank 102 is held approximately constant by the energy transfer means 108, the amount of energy transferred to the capacitor bank 102 depends on the period of time the capacitor bank is allowed to charge. The charging time period for the capacitor bank 102 is set by a timer circuit 124, which controls the AND gate 122. It is noted that energy charge rates and charges times must be coordinated so that desired amounts of energy are stored in the capacitor bank for each strobe flash and the strobe lamp can be flashed at a specified repetition rate.

During charge periods, the AND gate 122 is enabled so that the signal from the pulse width modulator 120 is applied to the switch means 110 and energy is transferred from the power source 100 to the capacitor bank 102 at the selected energy transfer rate. When the desired amount of energy has been transferred into the capacitor bank 102, i.e., a defined period of time has elapsed, the timer circuit 124 operates to disable the AND gate 122 and stop the charging of the capacitor bank 102.

The timer circuit 124 can also be used to activate a pulse transformer 126 to activate or trigger the strobe lamp 106. Thus, each time the capacitor bank 102 has charged for the period of time set by the timer 124 and, therefore received a designated amount of charge, the timer disables the AND gate 122 and operates the strobe lamp 106. The timer 124 continues to disable the AND gate 122 for a designated period of time to provide afterglow protection for the strobe lamp 106. It is noted that the timer circuit is also coupled to the summing circuit 116, the integrator 118, or the pulse width modulator 120 to start the charging cycle from a zero duty cycle or the minimum duty cycle provided by the pulse width modulator 120. Such control of the duty cycle ensures controlled current levels within the circuit and a graceful build up of the charging current for reduced EMI.

FIG. 2 is a detailed schematic diagram of a strobe light system in accordance with the present invention. The reference numerals of FIG. 1 are used to designate corresponding circuitry where appropriate.

In the embodiment of FIG. 2, the unregulated DC power source 100 comprises a source of alternating current 200, an input filter made up of series inductors 201 and a capacitor 202, the diodes 203 which form a full wave rectifying bridge and a capacitor 204. Of course, a battery or any other regulated or unregulated source of DC power could be used in accordance with the present invention. The capacitor means or bank 102 comprises parallel connected capacitors 205. The strobe lamp 106 is shown in FIG. 2 as being triggered by a high voltage ignition transformer 206 as opposed to an ignition terminal as shown in the strobe lamp of FIG. 1. Both illustrated triggering systems, as well as other triggering systems, are well known in the art and can be used in the present invention.

The inverter transformer charting means 104 is controlled by the transitor switch 110 with the primary input current to the transformer 104 being monitored by the resistor 112. The signal generated across the resistor 112 which is representative of the primary input current to the inverter transformer 104 is amplified by the amplifier circuit 114 and subtracted from the voltage of the power supply 100 by the summing circuit 116 which comprises resistors 207, 208, 209 and a variable resistor 210.

The integrator circuit 118 integrates the signal from the summing circuit 116 and passes it to the modulator input 211 of the pulse width modulator 120. The pulse width modulator 120 drives the transitor 110 via the output conductor 212 and the transitor 213.

The timer circuit 124 is connected to the input of the amplifier 114 rather than to an AND gate as shown in FIG. 1. This connection of the timer circuit 124 ensures the proper start up of each capacitor bank charging period as previously described. There are a large number of ways that the timer circuit 124 can be connected into the circuit to properly control the charging of the capacitor bank 102, as will be apparent to those skilled in the art.

For this timer control arrangement, when the set period of time for charging the capacitor bank 102 has elapsed, the timer 124 activates a transitor 214 to overdrive the amplifier 114 causing the pulse width modulator 120 to shrink the pulse width to zero, thus terminating the charging of the capacitor bank 102.

At the end of each charging period, the timer circuit 124 also controls a transistor 215 to operate a silicon controlled rectifier (SCR) 216 via a conductor 217. Operation of the SCR 216 discharges a capacitor 218 through the ignition transformer 206 to flash the strobe lamp 106. The capacitor 218 is charged in parallel with the capacitors 205 during the charging period defined by the timer 124.

The timer circuit 124 maintains the transistors 214 and 215 active for a desired time period after ignition to provide afterglow protection for the strobe lamp 106.

Exemplary circuit components and component values for the embodiment of the invention shown in FIG. 2 are as follows:

| | |
|---|---|
| 104 | Transformer 1:2 ratio (Ferrox cube #4224-L00-3C8) gap at .035, approximately 3 mh primary inductance |
| 106 | Flash tube |
| 110 | Switching transistor such as MJ10003 available from Motorola Semiconductor Products |
| 112 | 0.3 ohm, 1 W |
| 117 | Switch |
| 120 | Pulse width modulator such as NE/SE 5560 available from Signetics Corporation |
| 124 | Timer circuit, such as ICM 7555 available from Intersil |
| 200 | 115 V 400 HZ |
| 201 | 6 mh air core choke, 50 mh choke |
| 202 | 0.1 mfd |
| 203 | IN 5552 |
| 204 | 100 mfd, 200 V |
| 205 | 1400 mfd, 300 V, total of capacitor bank |
| 206 | Trigger transformer 1:30 ratio (Ferrox cube #3428-L00-3C8) one turn on primary |
| 207 | 619 K ohms |
| 208 | 100 K ohms |
| 209 | 7.5 K ohms |
| 210 | 10 k ohms |
| 213 | 2N2222 |
| 214 | 2N2907 |
| 216 | SCR, such as S4001 M53 available from ECC Corp. |
| 219 | Diode, such as MR-917 available from Motorola Semiconductor Products |
| 220 | 220 ohms 2 W |

-continued

| | |
|---|---|
| 221 | 4.7 K ohms |
| 222 | 100 ohms 1 W |
| 223 | .22 mfd |
| 224 | 470 K ohms ½ W |
| 227 | 6.8 K ohms |
| 228 | 22 K ohms |
| 229 | 10 K ohms |
| 230 | 30.1 K ohms |
| 231 | 3 K ohms |
| 232 | 470 mmf |
| 233 | 5.1 K ohms |
| 234 | 10 K ohms |
| 235 | 18.2 K ohms |
| 236 | 30.1 K ohms |
| 237 | .01 mfd |
| 238 | .01 mfd |
| 239 | 1 Meg. ohms |
| 240 | 80 K ohms |
| 241 | 1 mfd |
| 242 | 10 K ohms |
| 243 | 10 K ohms |
| 244 | 49.9 K ohms |
| 245 | 49.9 K ohms |
| 246 | Operational amplifier, such as LM124 available from National Semiconductor |
| 247 | .22 mfd |
| 248 | Operational amplifier, such as LM124 available from National Semiconductor |
| 249 | 4.7 K ohms |
| 250 | 15 K ohms |
| 251 | .003 mfd |
| 252 | 10 K ohms |
| 253 | .01 mfd |

Note:
Resistors are ¼ watt unless otherwise specified.

The components connected to the timer circuit 124 select the duty cycle and frequency of operation of the timer which is connected for astable operation.

The components connected to the pulse width modulator 120 select the maximum duty cycle of the output signal, the sawtooth waveform for the modulator, provide protection for the strobe system by shutting down the pulse width modulator 120 for over voltage or over current conditions within the circuit and generate the precision reference voltage $V_R$ for use elsewhere within the circuit. These circuit functions are not required for the present invention but are conveniently available when the above-identified integrated circuit of FIG. 2 is used to provide the pulse width modulator 120 for the strobe light system.

While the invention has been disclosed with reference to an illustrative embodiment, a variety of embodiments and modifications will be apparent to those skilled in the art. For example, the control of the timer circuit in setting the charge time period can be by AND gate as shown in FIG. 1, by overdriving the current sensing amplifier as shown in FIG. 2, by direct control of the pulse width modulator, by other circuit connections apparent to those skilled in the art or by combinations of those control connections. Further, other charging circuit configurations will be apparent to those skilled in the art. These modifications as well as other modifications and alternate embodiments are considered to be within the true spirit and scope of the present invention.

What is claimed is:

1. In a strobe light wherein capacitance means is successively charged by a power source and discharged through a strobe lamp, the charge control system comprising:

charging means for coupling said power source to said capacitance means;

energy transfer means connected to said charging means including switch means connected into the input side of said charging means to control the duty cycle of the input current to said charging means and switch control means monitoring the input to said charging means including pulse width modulator means connected to drive said switch means, thereby regulating the rate of energy transfer between said ppower source and said capacitance means generally to a preselected energy transfer rate; and, timer means operatively connected to said energy transfer means for setting a preselected duration in which energy is transferred from said power source to said capacitance means, whereby charging the capacitance means at the preselected energy transfer rate for the preselected energy transfer duration sets the amount of energy with which the capacitance means is charged.

2. The charge control system of claim 1 wherein said energy transfer means includes current monitoring means so that said switch control means and said switch means connected thereto maintain an input current to said charging means approximately constant during energy transfer from said power source to said capacitance means.

3. The charge control system of claim 1 wherein said charging means receives an input current and an input voltage from said power source and said switch control means includes monitoring means for monitoring both the input current and the input voltage and with said switch means regulates the input current to said charging means such that a constant rate of energy transfer is maintained between said power source and said capacitance means.

4. The charge control system of claim 3 wherein said timer means is further coupled to said strobe lamp for activating said strobe lamp upon termination of said energy transfer duration.

5. The charge control system of claim 4 wherein after said energy transfer duration said timer sets an afterflow protection duration in which no energy is transferred to said capacitance means from said power source, whereby afterglow protection is provided for said strobe lamp.

6. A strobe light system comprising:

a source of electrical energy;

a strobe lamp;

capacitance means connected across said strobe lamp for storing energy to be discharged into said strobe lamp;

charging means connected between said source of electrical energy and said capacitance means for transferring energy from said source to said capacitance means;

energy transfer means connected to said charging means for controlling the current flow from said source of energy to said charging means including switch means connected into the input side of said charging means to control the duty cycle of the input current to said charging means and switch control means monitoring the input to said charging means including pulse width modulator means connected to drive said switch means to maintain an approximately constant rate of energy transfer between said source of energy and said capacitance means; and, timer means connected to said energy transfer means for setting an array transfer duration whereby an approximately constant amount of energy is transferred from said source of electrical energy to said capacitance means.

7. The strobe light system of claim 6 wherein said charging means receives an input current from said source of electrical energy and said switch control means monitors said input current for maintaining said input current at an approximately constant effective valve.

8. The strobe light system of claim 6 wherein said charging means receives an input current and an input voltage from said source of electrical energy and said switch control means monitors both said input current and said input voltage for maintaining the effective value of said input current at a valve so that the rate of energy transfer from said source of electrical energy to said capacitance means is approximately constant.

9. The strobe light system of claim 8 wherein said switch control means comprises:

current monitoring means for generating a current signal voltage proportional to the effective value of the input current to said charging means;

a summing means for generating an energy transfer rate signal representative of an algebraic combination of said input current signal voltage and said input voltage; and, an integrator means connected to said summing means for generating an output signal proportional to the integral of said energy transfer rate signal;

said pulse width modulator means being connected to receive said output signal and to generate a switch control signal in response thereto defining said duty cycle of said switch means.

10. The strobe light system of claim 9 wherein said timer means is coupled to said energy transfer means to initiate the charging of said capacitance means at the minimym duty cycle provided by said pulse width modulator means.

11. A strobe light system comprising:

a source of DC electrical energy;

a strobe lamp;

capacitance means connected across said strobe lamp for storing energy to be discharged into said strobe lamp;

charging means receiving an input voltage and an input current from said source of electrical energy and being connected with said capacitance means for scaling and transferring the voltage and current from said source to said capacitance means;

switch means connected to said charging means for activating said charging means;

current monitoring means connected to said charging means for generating a current signal voltage proportional to the effective value of said input current of said charging means;

summing means connected to said current monitoring means and said charging means for algebraically combining said current signal voltage and said input voltage to generate an input energy signal;

integrator means connected to said summing means for generating an error signal proportional to the integral of said input energy signal;

pulse width modulator means connected to said integrator means and responsive to said error signal for generating duty cycle signals, said switch means being cyclically operated in response to said duty cycle signals; and, timer means for setting an energy transfer duration during which said witch means is operated by said duty cycle signals.

12. The strobe light system of claim 11 further comprising a trigger means coupled to said strobe lamp and said timer means for activating said strobe lamp after the energy transfer duration.

13. The strobe light system of claim 12 wherein said charging means includes an inverter transformer.

14. The strobe light system of claim 13 wherein said timer means is coupled to said summing means.

* * * * *